F6966 XR 4,248,729

United States Patent [19]

Rubingh et al.

[11] 4,248,729

[45] Feb. 3, 1981

[54] DETERGENCY BOOSTER

[75] Inventors: Donn N. Rubingh; Theodore C. Stephens, both of Cincinnati, Ohio

[73] Assignee: The Proctor & Gamble Company, Cincinnati, Ohio

[21] Appl. No.: 968,897

[22] Filed: Dec. 13, 1978

Related U.S. Application Data

[63] Continuation of Ser. No. 905,714, May 15, 1978, abandoned.

[51] Int. Cl.[3] ..... C11D 1/83

[52] U.S. Cl. ..... 252/174.22; 252/95; 252/99; 252/135; 252/174.21; 8/108 R; 8/111; 8/137

[58] Field of Search ..... 252/95, 99, 89 R, 135, 252/174.21, 174.22; 8/111, 108, 137

[56] References Cited

U.S. PATENT DOCUMENTS

| | | | |
|---|---|---|---|
| 3,925,224 | 12/1975 | Winston | 252/89 R |
| 3,983,078 | 9/1976 | Collins | 252/89 R |

FOREIGN PATENT DOCUMENTS 860898 1/1971 Canada .

*Primary Examiner*—Mayer Weinblatt

*Attorney, Agent, or Firm*—Ronald L. Hemingway; Jerry J. Yetter; Richard C. Witte

[57] ABSTRACT

Detergency boosters comprise certain nonionic surfactants. When used at particular concentrations in conjunction with commercial laundry detergents in laundering liquors of about 70° C., and higher, followed by rinsing at about 66° C., or lower, the boosters herein provide improved fabric cleaning benefits. The nonionic surfactant detergency boosters herein are the ethoxylated primary aliphatic alcohols characterized by an average aliphatic chain length in the range $C_{12}$–$C_{13}$ and an average degree of ethoxylation of about 3.

2 Claims, No Drawings

DETERGENCY BOOSTER

This is a continuation of U.S. Ser. No. 905,714 (1970 series), filed by the present inventors on May 15, 1978, now abandoned.

Technical Field

The present invention relates to detergency booster compositions particularly adapted for use in commercial laundry operations. More particularly, certain $C_{12}$–$C_{13}$ ethoxylated surfactants have now been found to be unexpectedly superior detergency boosters, as compared with other ethoxylated nonionic surfactants when used under particular commercial laundering conditions for cleaning fabrics.

Heavy-duty detergency boosters are well known in the art. Usually, such boosters contain a synthetic organic detergent component which is generally anionic, nonionic or mixed anionic-nonionic in nature, and inorganic builder salts. Detergency boosters sometimes contain organic solvents to help remove grease and oil from fabrics. While such booster compositions may be effective for some types of laundering, the search for optimal performance continues.

BACKGROUND ART

U.S. Pat. No. 3,925,224 (1975) describes a detergent additive composition containing a water-insoluble surfactant or water-insoluble/water-soluble surfactant mixtures. The detergent additive composition is said to enhance the detergency of conventional detergent products. The specification discloses that the surfactant must be insoluble at the usage temperatures of the wash liquor. In Examples 1–6 soiled fabrics were washed at 55° C. and rinsed in warm tap water.

U.S. Pat. No. 3,983,078 (1976) discloses compositions and methods for dissolving oils and oily soils employing specific mixtures of short chain and long chain alkylene oxide nonionic surface active agents.

Canadian Pat. No. 860,898 (1971) discloses the use of ethoxylated $C_8$–$C_{15}$ aliphatic alcohols as detergency improvers. These nonionic surfactants are added to a water-soluble mixed anionic and/or nonionic system.

British Patent 1,118,297 (1968) discloses low-foaming, washing and cleansing compositions containing a detergency adduct which is a water-insoluble ethyoxylated alcohol. The examples assert increased soil removal when the detergent compositions were used at 60° C. rather than 40° C.

Volkov, et al., *Kolloid. Zh.*, 34, 607 (1972) describe the effect of alkali metal cations on the phase transitions of nonionic surfactant solutions. Electrolytes were shown to decrease both the lower and the upper solubility temperatures of the nonionic surfactant $\alpha$-hydro-$\omega$-(tetradecyloxy) poly (oxyethylene).

Volkov, et al., *Ibid.*, 35, 738 (1973) discuss the phase transformation of aqueous solutions of nonionic surfactants with changes in temperature, concentration, and the extent of oxyethylation.

Harusawa, et al., *Colloid and Polymer Sci.*, 252, 613 (1974) discuss the phase equilibria of water, dodecane, and $C_{12}E_5$ systems.

Olteanu, et al., *Rev. Chim.* (Bucharest) 24,597 (1973) describe measurements of the phase inversion temperatures of hydrocarbon emulsions with nonionic surfactants.

Typical examples of concentrated liquid detergents are disclosed in U.S. Pat. Nos. 2,086,867, Hall 7/1937; 2,551,634, Price 5/1951; 2,770,599, Henkin 11/1956; 2,947,702, Coskie 8/1960; 3,239,468, Herrick 3/1966; 3,554,916, Kerfoot 1/1971, 3,594,323, Taylor 7/1971; 3,663,445, Augustin 5/1972; 3,697,451, Mausner, et al. 10/1972; and 3,709,838, Mausner, et al. 1/1972.

Liquid detergents are also disclosed in: Canadian Pat. No. 615,853, 2/1961; and British Pat. No. 900,000, 6/1962; 842,813, 7/1960; and 759,877, 10/1956.

Other relevant references include Kastra, Defensive Publication of Ser. No. 182,863, filed 9/22/71 No. T903,009; Kastra, Defensive Publication of Ser. No. 182,883, filed 9/22/71 No. T903,010, and "Emulsions and Detergents", a booklet published by Union Carbide, 1961, especially pp. 7–9.

Other heavy-duty liquid detergent compositions are disclosed by Collins in U.S. Pat. No. 3,869,399, issued Mar. 4, 1975, and in U.S. Pat. No. 3,876,563, issued Apr. 8, 1975. The compositions disclosed in these patents are taught to be in gel form, provided no alcohol or electrolyte is present therein. The references cited at column 1 of each of these patents also disclose a variety of heavy-duty (not necessarily liquid) detergent compositions.

Compositions comprising electrolyte, water, and surfactant which seem to have been "salted-out" of solution by means of the electrolyte are disclosed in U.S. Pat. No. 3,235,505, Tuvell, issued Feb. 15, 1966. See also U.S. Pat. Nos. 3,591,508, Huggins, et al., issued July 6, 1971; and 3,060,124, Ginn, issued Oct. 23, 1962.

Pumpable liquid compositions consisting of concentrated ethoxylated nonionic surfactants and water are disclosed in U.S. Pat. No. 3,419,500, Rytter, et al., issued Dec. 31, 1968.

Non-gelling, concentrated liquid detergents are disclosed in U.S. Pat. No. 3,812,041, Inamorato, issued May 21, 1974.

Pasty spot-treating detergent concentrates are disclosed in U.S. Pat. No. 3,619,119, Felletschin, et al., issued Nov. 9, 1971.

Ethoxylated detergent compositions thickened with a polyvinyl acetate maleate thickener are disclosed in U.S. Pat. No. 2,645,415, Pollok, issued July 14, 1963.

Liquid detergent concentrates are disclosed in U.S. Pat. No. 3,776,581, Cheng, issued Dec. 4, 1973.

Detergents comprising anionic and nonionic surfactants are disclosed in U.S. Pat. No. 3,140,261, Noad, issued July 7, 1964.

German Offen. No. 2,403,229, Anmeldetag, Jan. 14, 1974, Smithies, discloses detergent concentrates with indicator systems.

In spite of the substantial body of work in the area of heavy-duty liquid detergents and heavy-duty detergency boosters, the particular advantages and superior performance of compositions of the type disclosed herein do not appear to have been appreciated heretofore.

DISCLOSURE OF INVENTION

The present invention is based on the discovery that certain nonionic surfactants of the type disclosed hereinafter enhance the detergency power of other detersive surfactants when used in a laundering operation which is carried out in an aqueous liquor at temperatures of about 70° C., or higher, followed by a rinse at temperatures of about 66° C., or lower. Wash/rinse temperatures within these ranges are somewhat higher than commonly used in home laundries, but are typical of the wash/rinse temperatures employed in commercial laundries to remove soils and stains from mechanics' clothing, industrial wiping cloths, and like fabrics which carry exceptionally high soil loads.

The detergency booster nonionic surfactants employed herein are selected from the ethoxylated, primary aliphatic alcohols which are characterized by an average aliphatic chain length in the range of $C_{12}$–$C_{13}$ and an average degree of ethoxylation of about 3, and mixtures of said ethoxylated primary aliphatic alcohols.

The ethoxylated detergency booster probably deposits on the fabric in high amounts and this deposition provides the unexpectedly high increase in performance because of two factors: first, the high amount of the nonionic surfactant booster deposited at the work site where it combines with soil; second, as the temperature drops in the rinse, the deposited surfactant/soil is quickly dispersed as the surfactant is re-dissolved in the rinse bath. If aqueous rinse temperatures of about 70° C., and above, were to be used, some of the detergency booster and soil would preferentially remain on the fabric surface rather than being partitioned into the aqueous rinse bath. The ethoxylated primary aliphatic alcohol boosters used herein have the additional, critical property that, while they preferentially partition onto fabric surfaces from an aqueous laundering liquor at high laundering temperatures, they also re-partition from the fabric surface into rinse water, bearing their soil load, at temperatures of about 66° C., or lower.

Because of the fabric/water partitioning properties of the ethoxylated primary aliphatic alcohol detergency boosters used herein, the present invention provides a process for laundering fabrics, comprising agitating said fabrics with an aqueous laundering liquor containing said detergency booster, said laundering liquor being at a temperature of about 70° C., preferably about 80° C., or higher, said agitation being carried out for a period of time usually from about 1 minute to about 30 minutes, and thereafter rinsing said fabrics with water at temperatures of about 66° C., preferably about 60° C., and lower.

Best Mode of Carrying Out the Invention

The detergency booster materials employed in the practice of this invention are of the formula n-$C_xH_{2x}(OCH_2CH_2)_y$ wherein x is an integer having an average value of from about 12 to about 13 and wherein y is an integer having an average value of about 3. It will be appreciated that the detergency booster materials are ethoxylated primary aliphatic alcohols which are commercially available under tradenames such as NEODOL 23–3 (preferred for use herein). These detergency boosters are prepared by ethoxylating primary aliphatic alcohols to an average degree of ethoxylation of about three. On a commercial scale, alcohol mixtures may be employed; moreover, the ethoxylation procedure cannot be precisely controlled, and some lower ethoxylates and some higher ethoxylates may be present in commercial mixtures. Such mixtures are useful herein, so long as they comprise a major proportion of the ethoxylated (average three) primary aliphatic $C_{12}$–$C_{13}$ (average) alcohols.

As disclosed hereinabove, the detergency boosters seem to function by partitioning onto fabric surfaces and soils at relatively high laundering liquor temperatures, and re-partitioning with their soil load back into a relatively low temperature aqueous rinse bath. Surprisingly, excessively high concentrations of the ethoxylated primary aliphatic alcohol detergency boosters in the laundering liquor give poorer performance than do lower concentrations formulated within a critical concentration range. This behavior of the present detergency boosters is quite unusual, inasmuch as with most boosters, the more used, the better. The reason for this unusual behavior is not known. However, it may be that excessive amounts of the ethoxylated primary aliphatic alcohol detergency boosters in the higher temperature laundering liquor may cause too much booster to be deposited on the fabric surfaces. When the fabrics are rinsed using a normal rinse cycle from about 0.5 minutes to about 30 minutes (usually 5–10 minutes) the excessive booster, with its soil load, may not be completely removed from the fabrics. Whatever the reason, it has now been discovered that there is an optimal concentration range over which the detergency boosters of the present invention are used to provide optimal detergency performance.

The operable concentration range for the boosters in an aqueous laundering liquor is from about 0.075% to about 0.20% by weight of said liquor; a preferred usage concentration range is from about 0.1% to about 0.13%, and the optimal $C_{12}$–$C_{13}$ (avg.) aliphatic alcohol ethoxylate (avg. 3) detergency booster is most preferably used at a concentration of about 0.125% by weight of the aqueous laundering liquor. These concentration ranges are especially preferred for securing optimal booster performance with NEODOL 23–3.

The ethoxylated primary aliphatic alcohol detergency boosters disclosed herein are not employed by themselves to launder fabrics. Rather, a detergency booster is combined in an aqueous laundering liquor with detersive surfactants and, optionally, other detersive adjunct materials such as detergency builders, bleaches, water softeners, soil suspending agents, and like materials typically used in a fabric laundering operation. The fabric laundering operation is carried out by agitating said fabrics with the laundering liquor, said laundering liquor being at the temperature of about 70° C., preferably about 80° C., or higher, for a period of time from about 1 minute to about 30 minutes, and thereafter rinsing said fabrics with water at temperatures of about 66° C., preferably about 60° C., or lower.

In a preferred mode, the rinse is carried out using water which is free from booster, detersive surfactant, detergency builders, etc.

As can be seen from the foregoing, the present invention encompasses aqueous laundering liquors comprising:

(a) from about 0.075% to about 0.20% (preferably from about 0.1% to about 0.13%, most preferably about 0.125%) by weight of said liquor of a detergency booster which is an ethoxylated primary aliphatic alcohol characterized by an average aliphatic chain length in the range of about $C_{12}$–$C_{13}$ and an average degree of ethoxylation of about 3; and (b) from about 0.02% to about 0.12% (preferably from about 0.02% to about 0.08%) by weight of said liquor of a detersive surfactant selected from nonionic and anionic detersive surfactants, and mixtures thereof;

(c) from about 0% to about 1.5% (preferably from about 0.2% to about 0.9%, most preferably about 0.85%) by weight of said liquor of a detersive adjunct material selected from detergency builders, bleaches, water softeners, soil suspending agents, thermally-stable enzymes, etc., and mixtures thereof as disclosed hereinafter; and (d) the balance of said laundering liquor comprising water.

For convenience, it is possible to formulate finished laundering compositions, said laundering compositions containing both the detergency booster and a detergency component which comprises a detersive surfactant, optional detergency adjunct components, inert fillers, and the like, said laundering composition being especially adapted for cleaning soiled fabrics by washing said fabrics in the presence of an aqueous liquor containing said composition at temperatures of about 70° C., preferably about 80° C., or higher, and thereafter rinsing said fabrics at temperatures of about 66° C., preferably about 60° C., or lower. Such laundering compositions comprise:

(a) from about 7.5% to about 20% by weight of the detergency booster component which is an ethoxylated primary aliphatic alcohol characterized by an average aliphatic chain length in the range of $C_{12}$–$C_{13}$ and an average degree of ethoxylation of about 3; and (b) the balance of the composition comprising a detergency component comprising from about 4% to about 12% by weight of a detersive surfactant selected from nonionic and anionic surfactants, and mixtures thereof, and from about 0% to about 90% by weight of detergency adjunct components and inert fillers.

Commercial, heavy-duty laundering compositions of the foregoing type often contain high concentrations of alkali. The detergency boosters herein are not particularly stable on long term contact with base. Accordingly, to provide storage stability, the booster and base can be separated by encapsulating either, or both, with water-soluble encapsulating agents such as the gums, polysaccharides, etc., well known in the encapsulation arts.

INDUSTRIAL APPLICABILITY

The detergency boosters of the present invention are used to enhance the fabric cleaning power of commercial heavy-duty laundering products which typically comprise detersive surfactants and optionally contain various detergency adjunct materials. The detersive surfactants used in laundering products include the anionic soap and non-soap synthetic detersive surfactants.

The class of anionic detersive surfactants includes the ordinary water-soluble alkali metal soaps such as the sodium, potassium, ammonium, and alkanol ammonium salts of fatty acids containing from about 10 to about 20 carbon atoms. Soaps are secured by saponifying fats and oils from natural sources such as palm oil, coconut oil, tallow, and the like, with an appropriate base.

The class of anionic detersive surfactants also includes the water-soluble salts, particularly the alkali metal salts, of organic sulfuric reaction products having in their molecular structure an alkyl group containing from about 8 to about 22 carbon atoms and a sulfonic acid or sulfuric acid ester group. Examples of this subclass of synthetic detersive surfactants which are preferred for use in the practice of this invention include the sodium and potassium alkyl sulfates, especially those materials obtained by sulfating the higher alcohols ($C_8$–$C_{18}$) produced by reducing the glycerides of tallow or coconut oil; and the sodium and potassium alkyl benzene sulfonates, especially those alkyl benzene sulfonates in which the alkyl group contains from about 9 to about 15 carbon atoms, in straight or branched chain configuration. Especially useful are those linear straight chain alkyl benzene sulfonates in which the average chain length of the alkyl groups is about 13 carbon atoms. The sodium alkyl glyceryl ether sulfonates, especially those ethers of higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1–6 moles of ethylene oxide; alkali metal salts of alkyl phenol ethylene oxide ether sulfates; and like materials well known in the detergency arts as useful anionic detersive surfactants for cleansing fabrics can all be employed herein. Specific examples of such detersive surfactants are described in standard texts on the subject, and are set forth in U.S. Pat. No. 3,664,961, issued May 23, 1972, the disclosures of which are incorporated herein by reference.

Commercial laundering products also often contain various nonionic detersive surfactants. The referenced U.S. Pat. No. 3,664,961 discloses various types of nonionic detersive surfactants which can be employed in the practice of the present invention. Examples of various sub-classes of nonionic detersive surfactants include the amine oxides, the phosphine oxides, the sulfoxides, the alkyl phenol ethoxylates, the secondary alcohol ethoxylates and the primary alcohol ethoxylates having an average degree of ethoxylation in the range from about 5 to about 35 and an average alkyl chain length from about 12 to about 18.

It will be appreciated that the relatively long alkyl chain length and/or relatively high degree of ethoxylation and/or the presence of an alkyl phenol substituent and/or the secondary alcohol moiety as opposed to primary are all features which distinguish typical ethoxylated nonionic detersive surfactants which may optionally be used herein from the ethoxylated detergency boosters which must be used herein, in the manner disclosed, to achieve the benefits described.

Detergency adjunct materials are commonly present in commercial laundering products and such materials may optionally be used in the practice of the present invention. Indeed, one of the principal advantages of the present invention is that the detergency booster can be used with all manner of commercial laundering products without modification of their formulas.

Typical detergency adjunct materials include the water-soluble inorganic builder salts such as the alkali metal carbonates, borates, phosphates, polyphosphates, bicarbonates, sodium hydroxide, sodium metasilicate and sodium orthosilicate. Specific examples of such materials include sodium tripolyphosphate, sodium carbonate, sodium tetraborate, sodium and potassium pyrophosphate, sodium bicarbonate, potassium tripolyphosphate, sodium hexamethaphosphate, sodium sesquicarbonate, sodium orthophosphate and potassium bicarbonate.

Various organic sequestrant builder salts can also be used. Such materials include the ethylene-diaminetetraacetates, sodium phytate, sodium citrate, sodium maleate, soluble tartrates, and the like. Such materials are described in U.S. Pat. No. 3,664,961.

Also useful herein as detergency adjuncts are water softeners and builders such as the various clay minerals, synthetic zeolites, and the like, as described in the patent literature.

Also useful herein as detergency adjunct materials are various bleaching agents, including the hypochlorite bleaches which are marketed under a variety of tradenames, and perborate bleach.

Detergency adjunct enzymes, especially the proteolytic enzymes which are thermally stable, can also be used herein. One important type of detersive enzyme is obtainable from the Thermoactinomyces species of bacteria, expressly *Thermoactinomyces vulgaris* ATCC 15734.

Various soil-suspending agents such as carboxymethylcellulose, various cellulose ethers and esters, alum, and the like, can all be employed as detergency adjunct materials in laundering compositions and aqueous laundering liquors containing the detergency boosters of the present invention.

Commercial laundering compositions also typically contain various fillers and carriers, including water (for liquid compositions) and soluble agents such as sodium sulfate (for granular products). Such materials can also be employed herein.

The patents and other reference articles cited hereinbefore comprise a listing of substantially all manner of detersive surfactants and adjunct materials. Those patents and the other cited articles are incorporated herein by reference.

The following exemplifies several especially preferred embodiments of the present invention. Changes can be made in these embodiments without departing from the scope and spirit of this invention.

In general, heavy-duty laundering compositions designed for use in commercial laundries are characterized by high concentrations of base, as compared with home laundry products, and characteristically provide a laundering liquor pH of 12, and above. Such commercial products are typically used in laundering liquors at concentrations of about 1% by weight, and higher, for heavy soils and at concentrations of about 0.25% by weight for more lightly soiled fabrics. Stated otherwise, such products are typically used at levels of about 0.25 kg. to about 1.5 kg. per 45 kg. of soiled fabrics being laundered.

A superior, heavy-duty laundering composition used in commercial laundries comprises: from about 1% to about 5% by weight of an anionic detersive surfactant component, about one-third of which is linear alkyl benzene sulfonate and about two-thirds of which comprises a ca. 4:1 mixture of fatty alkyl sulfates and ethoxylated alcohol sulfates, all as disclosed hereinabove; from about 3% to about 7% by weight of a tallow alcohol ethoxylate which contains from about 25 to about 35 (avg.) ethoxyl groups; from about 0.5% to about 2% by weight of secondary $C_{11}$–$C_{15}$ alcohol ethoxylates (avg. EO 9); from about 3% to about 7% by weight of sodium tripolyphosphate; minor amounts of EDTA or hydroxyethyl EDTA; about 5% moisture and inert fillers such as sodium sulfate; minor amounts of soil suspending agents such as carboxymethylcellulose; the balance of the composition comprising a water-soluble base component which comprises sodium metasilicate, sodium hydroxide and/or sodium carbonate in varying ratios, depending on the desires of the formulator. The detergency boosters herein are especially effective when used with compositions of this type in the manner disclosed herein.

EXAMPLE I

A commercial, highly basic heavy-duty laundering product (PIERCE II) was used to test the detergency booster properties of the ethoxylated primary alcohol detergency boosters disclosed herein and to compare their detergency boosting performance with other types of ethoxylated nonionic surfactants. In the test, at temperatures above 70° C., soiled fabrics were laundered with the PIERCE II composition, using manufacturer's instructions and at usage levels in the laundering liquor within the range disclosed hereinabove (0.75%) in the presence of the boosters being tested. The ethoxylated primary aliphatic alcohol detergency booster disclosed herein (as NEODOL 23-3) and an alkyl phenol ethoxylate (as IGEPAL CO 630) were added to separate laundering liquors containing the PIERCE II formulation. These ethoxylates were used at concentrations of 0.1185% of the laundering liquor. Fabrics were laundered at temperatures above 70° C. for standard periods of time and rinsed at temperatures below 66° C. for standard periods of time. After drying, the fabrics were graded.

In tests of the foregoing type, the detergency booster performance (as measured by soil removal and fabric appearance) of the primary aliphatic alcohols characterized by an average aliphatic chain length in the range of $C_{12}$–$C_{13}$ and an average degree of ethoxylation of about 3 (NEODOL 23-3 which, commercially, can contain up to ca. 20% 2-methyl branched compounds) was found to be significantly better than the booster performance provided by the ethoxylated alkyl phenols, when used with the PIERCE II composition.

EXAMPLE II

Fabrics are laundered in a heavy-duty detergent at temperatures above 70° C. using a concentration of the NEODOL 23-3 of 1% by weight of the laundering liquor and rinsed at temperatures of ca. 60° C. Surprisingly, somewhat poorer detergency boosting performance is noted as compared with the results using the lower concentration of NEODOL 23-3 specified in Example I.

EXAMPLE III

A highly basic heavy-duty detergent composition comprising the following mixture of components is prepared by dry-blending the following materials.

| Ingredient | Wt. % |
|---|---|
| Linear alkyl benzene sulfonate ($C_{12}$–$C_{13}$ avg.) | 4.5 |
| Sodium carbonate | 22.5 |
| Sodium metasilicate | 35 |
| Sodium hydroxide | 18 |
| Sodium sulfate | 6 |
| Sodium tripolyphosphate | 6 |
| Tallow alcohol ethoxylate (30 avg.) | 5 |
| Carboxymethylcellulose | 2 |
| Moisture and minors | Balance |

An aqueous laundering liquor containing 1 % by weight of the composition of Example III and 0.125% by weight of NEODOL 23-3 is prepared in a commercial laundering machine. The temperature of the laundering liquor is 80° C. 45 kg. of fabrics heavily soiled with petroleum oils are introduced into the laundering machine and agitated in standard fashion for a period of about 20 minutes. (Called a "break" in the trade.) During this time, the temperature of the laundering liquor is maintained at about 80° C. Following this laundering operation, the laundering liquor is removed and replaced by fresh rinse water at a temperature of 60° C.

(Called a "carry over" in the trade.) The fabrics are agitated in the rinse bath for a period of about 5–10 minutes and the rinse water is drained. Additional rinses are employed, as necessary. The fabrics are dried and their cleanliness and appearance are found to be superior to fabrics washed in the same fashion, but without the NEODOL 23-3.

The procedure of Example III is carried out using the disclosed amount of NEODOL 23-3, but using a laundering liquor and a rinse bath temperature of about 60° C. Sub-optimal cleaning performance is secured.

EXAMPLE IV

A detergent composition is as follows:

| Ingredient | Wt. % |
|---|---|
| Linear alkyl benzene sulfonate ($C_{12}$–$C_{13}$ avg.) | |
| Sodium carbonate | 22 |
| Sodium metasilicate | 33 |
| Sodium hydroxide | 16 |
| Sodium sulfate | 6 |
| Sodium tripolyphosphate | 6 |
| Tallow alcohol ethoxylate (30 avg.) | 3 |
| Carboxymethylcellulose (CMC) | 2 |
| NEODOL 23-3* | 8 |
| Moisture and minors | Balance |

Granulated with the $Na_2SO_4$ and encapsulated with the CMC.

The composition of Example IV is prepared by dry-blending the ingredients.

An aqueous laundering liquor containing 1% by weight of the composition of Example IV is prepared in a commercial laundering machine. The temperature of the laundering liquor is 80° C. 45 kg. of fabrics heavily soiled with petroleum oils are introduced into the laundering machine and agitated in standard fashion for a period of about 20 minutes. During this time, the temperature of the laundering liquor is maintained at about 80° C. Following this laundering operation, the laundering liquor is removed and replaced by fresh rinse water at a temperature of 60° C. The fabrics are agitated in the rinse bath for a period of about 5–10 minutes and the rinse water is drained. The fabrics are dried and their cleanliness and appearance are found to be excellent.

What is claimed is:

1. A process for laundering fabrics, comprising agitating said fabrics with an aqueous laundering liquor consisting essentially of:

(a) from about 0.075% to about 0.20% by weight of said liquor of a detergency booster which is an ethoxylated primary hydrocarbon alcohol having an average hydrocarbon chain length in the range of about $C_{12}$–$C_{13}$ and an average degree of ethoxylation of about 3;

(b) from about 0.02% to about 0.12% by weight of said liquor of a material selected from the group consisting of nonionic and anionic detersive surfactants, and mixtures thereof; and (c) the balance of said laundering liquor is water; said laundering liquor being at a temperature of about 70° C., or higher, and thereafter rinsing said fabrics with water at temperatures of about 66° C., or lower.

2. A process according to claim 1 which comprises agitating the fabrics with said aqueous laundering liquor being at a temperature of about 80° C., or higher, said agitation being carried out for a period of time of from about 1 minute to about 30 minutes, and thereafter rinsing said fabrics with water at temperatures of about 60° C., and lower.

* * * * *

UNITED STATES PATENT AND TRADEMARK OFFICE

CERTIFICATE OF CORRECTION

PATENT NO. : 4,248,729

DATED : February 3, 1981

INVENTOR(S) : Donn N. Rubingh & Theodore C. Stephens

It is certified that error appears in the above-identified patent and that said Letters Patent are hereby corrected as shown below:

Col. 9, line 17, in Example IV under the column heading "Wt. %" opposite "Linear alkyl benzene sulfonate" insert the numeral -- 2 --.

Signed and Sealed this

*Twentieth* Day of *October 1981*

[SEAL]

*Attest:*

GERALD J. MOSSINGHOFF

*Attesting Officer*

*Commissioner of Patents and Trademarks*